US005263645A

United States Patent [19]

Paul et al.

[11] Patent Number: 5,263,645

[45] Date of Patent: Nov. 23, 1993

[54] FUEL INJECTOR SYSTEM

[76] Inventors: Marius A. Paul; Ana Paul, both of 1110 E. Elm Ave., Fullerton, Calif. 92631

[21] Appl. No.: 786,286

[22] Filed: Nov. 1, 1991

[51] Int. Cl.[5] ..... F02M 51/06

[52] U.S. Cl. ..... 239/124; 239/533.8; 239/463

[58] Field of Search ..... 239/533.8, 124, 533.12, 239/463, 486, 585.1-585.5

[56] References Cited

U.S. PATENT DOCUMENTS

| | | | |
|---|---|---|---|
| 2,279,010 | 4/1942 | Nichols | 239/533.8 |
| 2,283,725 | 5/1942 | Eichelberg | 239/533.8 |
| 3,469,793 | 9/1969 | Gueriler | 239/533.5 |
| 3,610,529 | 2/1972 | Huber | 239/533.8 |
| 3,777,977 | 12/1973 | Regneault et al. | 239/533.8 |
| 4,156,560 | 5/1979 | Cheklich et al. | 239/533.8 |

FOREIGN PATENT DOCUMENTS

| | | | |
|---|---|---|---|
| 521722 | 5/1940 | United Kingdom | 239/533.8 |
| 662547 | 12/1951 | United Kingdom | 239/486 |

*Primary Examiner*—Andres Kashnikow
*Assistant Examiner*—Kevin Weldon
*Attorney, Agent, or Firm*—Bielen, Peterson & Lampe

[57] ABSTRACT

A high pressure fuel injector having high pressure fuel admission passages and low pressure fuel return passages with a needle valve hydraulically operated by high pressure fuel from the high pressure fuel admission passage by a distributor valve which selectively directs a hydraulic pressure fuel against one side or the other of a piston body forming part of the needle valve whereby the needle valve is urged to a position closing discharge orifices or position opening discharge orifices the distributor valve being controlled by an electronic actuator.

2 Claims, 3 Drawing Sheets

FUEL INJECTOR SYSTEM

BACKGROUND OF THE INVENTION

This invention relates to a high pressure fuel injector that is suitable for high speed engines, particularly those having fuel injection controlled by an electronic fuel injection system. This invention relates to our fuel injector system described in U.S. Pat. No. 5,042,441, issued Aug. 27, 1991, entitled, "Low Emission Combustion System for Internal Combustion Engines". The fuel injector system of the referenced patent utilizes a high frequency pulsing in order to deliver a pulsed spray to the combustion chamber for fuel efficient combustion. The fuel injection system of the present invention can be adapted to accommodate the pulsed injector feature of our former patent.

In developing fuel injectors for high pressure, high speed engines, fuel economy and low emissions are important considerations. Accurate timing and metering of fuel is essential to achieve these goals. Prior art systems have inherent mechanical design limitations that render them unworkable for high pressure systems. In many such systems back pressures and reflected hydraulic pressure waves prevent the injector needle from firm seating and instantaneous cutoff once the fuel delivery cycle has been completed. This results in a lag in the fuel shut-off and leakage of additional fuel into the combustion chamber which is added in an inappropriate time during the engine cycle. This results in smoke from incomplete combustion and wasting of fuel.

In a high pressure engine, where the combustion chamber is designed for high pressure, high temperature combustion, injection systems must be designed to inject fuel at peak pressures at 200 to 400 atmospheres. The fuel must be injected in an appropriate manner to ensure that the actual fuel delivery coincides with the intended fuel profile. This is particularly important in electronic fuel delivery systems where the operating conditions are monitored electronically and fuel is metered according to engine performance and demand under control of a preprogrammed computer control system.

In multiple cylinder engines or in engines having one or more cylinders with multiple fuel injectors, it is customary to include a rail supply, which is essentially a high pressure fuel injector manifold, situated between the high pressure fuel injector pump and the fuel injectors. The rail supply holds a volume of high pressure fuel and operates as a surge control for modulating or buffering the periodic pulsing of the injectors. However, the high frequency pulsing of fuel released into the cylinders results in reflected pressure waves in the rail supply and other hydraulic components that appears to inhibit the fuel injector needle valve from seating and thereby fully closing the discharge orifices of the injector nozzle. In such a situation the actual fuel pulse has a long tail or injection dribble which is untimely to the operating cycle of the engine. Injection tail or leak results in incomplete complete combustion and pollution in the form of sooty or high carbon smoke.

The improved high pressure fuel injector of this invention eliminates post injection leak and cuts the trailing tail of the injection cycle at the point desired. The improved design enables substantial control over the injection cycle and renders the design of the fuel injector to be particularly applicable to electronically controlled fuel systems where the timing of the injector pulse can be varied electronically according to a predetermined system program.

SUMMARY OF THE INVENTION

The improved high pressure fuel injector of this invention is designed to eliminate the common phenomena called dribbling in which the injector nozzle fails to cease delivering fuel after the timed cycle pulse has completed. Prolonged fuel pulse tail at the post injection stage results in improper combustion with attendant pollution. The high carbon discharge gases may result in carbonization or coking of the injector nozzle tip causing the orifice size to shrink or causing distortion of the spray pattern for the fuel. The post injection fueling results from the inability of the injector needle to properly seat within the injector nozzle as a result of pressure spikes that result primarily from deflected pressure waves in the high pressure fuel supply components during injection cutoff. In general, the nozzle needle is pressed against a valve seat within the end of the nozzle by a spring. The force of the seating is generally determined by the supplied force of the compression spring with hydraulic forces from the high pressure fuel supply neutralized. Localized pressure peaks, however, can overcome the spring pressure and inhibit immediate cutoff of fuel injection by the fuel injector. These pressure peaks are traced primarily to the supply rail or accumulator where reflected pressure waves act to lift the needle valve.

In the improved high pressure fuel injector developed by applicants, an internal distributor valve directs the full pressure of the high pressure fuel supply against the back of the needle valve to insure an instantaneous and sharp cutoff of fuel injection after the programmed fuel pulse has been completed. The high pressure fuel injector of this invention can be integrated into any conventional injector system with either a mechanically or electronically controlled actuation.

In its preferred application, the high pressure fuel injector has an electronically controlled servo-system actuating a hydraulic distributor valve to sequentially direct the hydraulic force of the highly pressurized fuel for actuation of the needle valve in the injector nozzle for a smooth opening and a short and sharp closing. Because both of the actions on the needle valve are effected by the full constant pressure of the high pressure fuel supply, the opening and closing process is absolute.

The structural design of the high pressure injector utilizes the high pressure fuel supply to retain the injector in a closed position by acting on an enlarged segment of the back side of the needle valve to force the closure of the needle greatly exceeding combustion chamber pressures acting on the end of the needle valve or low pressure hydraulic pressures acting on the front side of the needle valve. Any pressure fluctuations in the high pressure fuel supply are directed at the top or backside of the needle valve. The tendency for the needle to lift is thereby totally eliminated. With the ability to precisely control the pulse of actual injection, the designed injector is particularly suitable for electronically controlled systems where pulse duration and pulse configuration can be varied in response to engine operating conditions.

In addition, the system is suitable for embodiments in which the timed pulse for an operating cycle can be multiplexed into a timed series of high frequency, micropulses within each cycle pulse. This feature can be accomplished electronically as described in the referenced patent or as disclosed with reference to one of the preferred embodiments of this invention. As disclosed herein, a mechanical means is constructed in which an induced hydraulic instability is effected to provide a series of needle lift oscillations within the duration of the timed injection pulse. Utilizing micro multiple injection pulses during a controlled injection period permits control of the heat release within the engine cylinder and enables optimization of fuel economy and pollution reduction.

The enhanced capabilities of the improved injector also make the injector suitable for multifuel capability with the injector being programmable for a variety of liquid fuels. Furthermore, by minor alterations in the size of the discharge orifices of the injector nozzle, the improved injector can be utilized for gaseous as well as liquid fuels. In certain embodiments, the improved high pressure fuel injector includes a nozzle tip with an orifice design that utilizes multiple tangential nozzle orifices that in conjunction with the conical shape of the needle tip and needle seat, generates a super high rotation the to the discharging spray. This design results in an efficient mix of the fuel spray with the compressed air in the combustion chamber for effective atomization and clean combustion. With the utilization of a constricted conical space between the conical needle valve tip and the conical needle seat, the tangential nozzle holes can be larger then conventional size enabling the total injection time to be shortened. This feature is particularly important in high rotation engines.

The various features here described combine to provide an improved fuel injector suitable for lower pressure spark ignited engines or advanced, hyperbar diesel engines.

DESCRIPTION OF THE PREFERRED EMBODIMENTS

Figure 1:
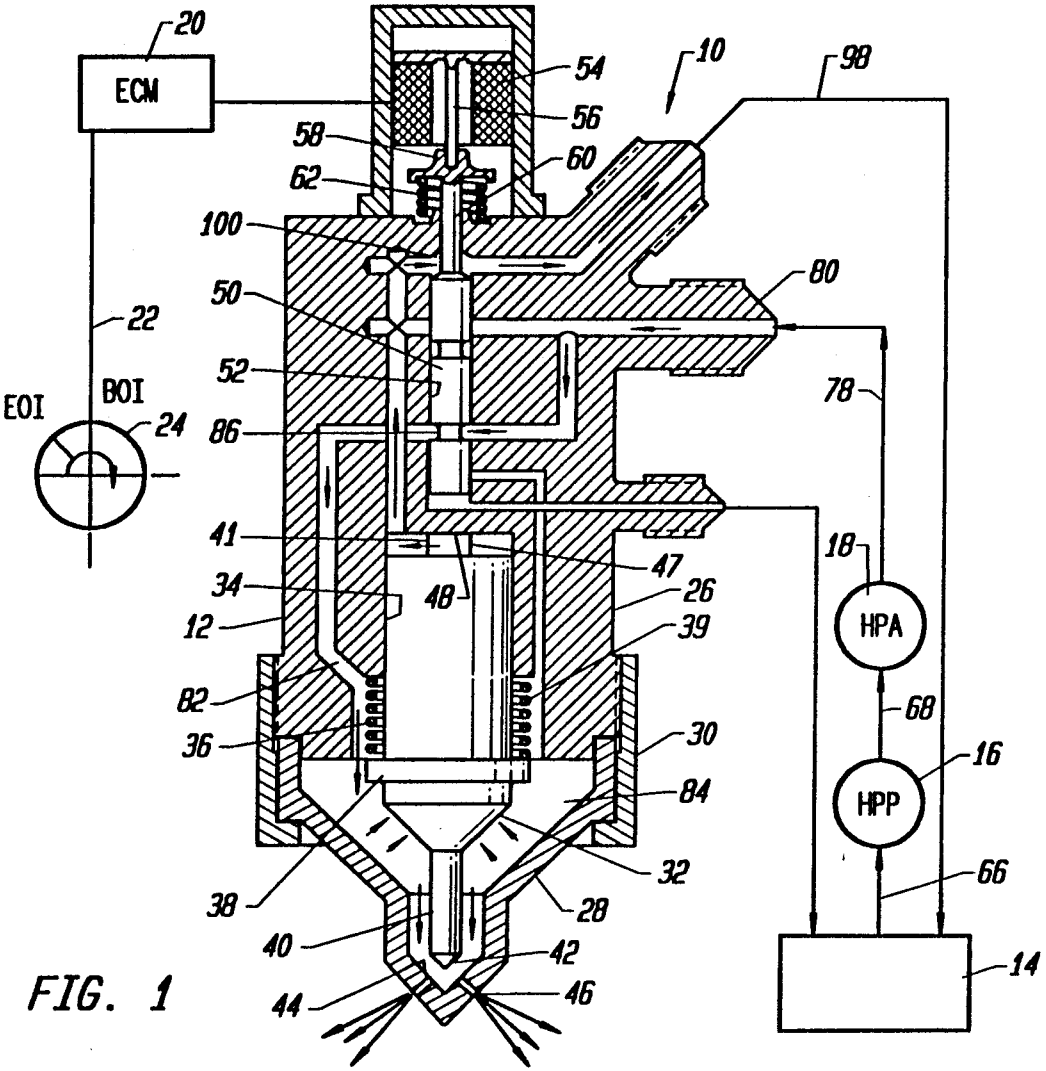
FIG. 1 is a cross-sectional view of the improved high pressure fuel injector in a fuel injector system with the valve needle of the injector in an open position during fuel injection.

Referring now to FIG. 1, a high pressure fuel injector system, designated generally by the reference numeral 10 is shown partly schematically. The fuel injector system 10 includes a high pressure fuel injector 12, a fuel reservoir 14. The fuel reservoir 14 supplies a high pressure fuel pump 16 that delivers fuel to a high pressure accumulator 18 which in turn supplies one or more injectors of the type shown in FIG. 1. The injector 12 may be cam operated or operated by other mechanical means. It is preferred, however, that the injector 10 be controlled by an electronic control module 20. The electronic control module 20 has an input feed line 22 that at least senses the cycle of operation of the engine 24 for controlling the timing of the injection pulse. The input line 22 can comprise a network of electronic sensors that monitors the engine operating conditions and provides data to the electronic control module 20 for optimized control of the fuel injector 12 pursuant to a programmed procedure.

Figure 2:
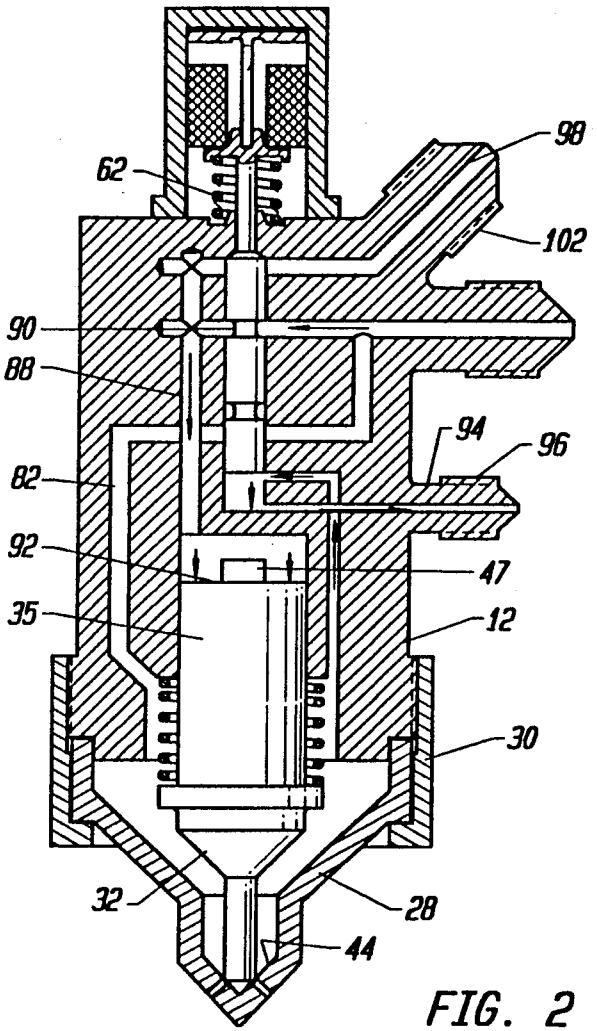
FIG. 2 is a cross-section view of the injector of FIG 1 with the valve needle in a closed position blocking fuel injection.

The fuel injector 12, also shown in the cross-sectional view of FIG. 2, includes a injector body 26 having a series of supply and return passages for fuel delivery, and, the necessary bores for the valving of the discharge as detailed hereafter. A replaceable nozzle 28 is connected to the injector body 26 by a joint nut 30 and together with the body 26 houses an axially displaceable valve needle 32 having a piston body 35 with a back end 37. The valve needle 32 is freely displaceable in a central bore 34 in the injector body 26. The valve needle is biased by a compression spring 36. The compression spring 36 seats against a flange 38 on the valve needle 32 and against a rim 39 on the bore 34. The bore of the injector body and back end 37 of the piston body 35 form a hydraulic chamber 41 that alternately communicates with the low pressure reservoir or high pressure accumulator 18. The valve needle 32 has a tip 40 that has a conical end 42 which seats against the conical inside wall 44 of the nozzle 2 blocking the discharge orifices 46 as shown when seated in FIG. 2. The valve needle 32 is hydraulically displaceable in the bore 34, from the retracted position shown in FIG. 1, where stop 47 contacts the bore end 48, to the extended position shown in FIG. 2, where the end 42 of the tip 40 firmly contacts the inner conical wall 44 of the nozzle 28.

Displacement of the valve needle 32 is controlled by positioning of the distributor valve 50 which is axially displaceable in a bore 52 in the injector body 26. Displacement of the distributor valve 50 is controlled by a solenoid 54, which has an axially displacable armature 56. The armature 56 engages a cap 58 on the end extension 60 of the distributor valve 50 and displaces the distributor valve 50 on displacement of the armature 56. The distributor 50 is maintained in a position that blocks discharge of fuel from the injector 12 on deactivation of solenoid 54 by a compression spring 55 that seats between a cap 58 on an end extension 60 on the distributor valve 50 and a depression 62 in the injector body 26. The distributor valve 50 opens and closes fuel passages during operation of the valve and allows a pulsed supply of fuel to the discharge orifice in the nozzle.

In operation, fuel is drawn from the reservoir 14 by the pump through a supply line 66 where it is passed through a high pressure line 68 to the high pressure accumulator 18, which may comprise a supply rail or manifold for multiple fuel injectors or a small high pressure reservoir that acts as a buffer or surge for a single injector. From the accumulator 18, a high pressure line 78 connects with the fuel input nipple 80 on the injector body 26. The fuel input line 78 bifurcates with one passage forming a discharge line 82 that supplies a plenum 84 in the injector nozzle 28. In FIG. 1, the distributor valve 50 is displaced to position a constricted section 86 at the passage 82 to permit fuel flow through the passage. In this position, the high pressure fuel in the plenum 84 of the nozzle 28 hydraulically acts on the nozzle tip 40 including the nozzle flange 38 forcing the compression spring 36 to compress and the nozzle needle to displace to the position as shown in FIG. 1. In such position, the passage to the discharge orifices 46 is clear allowing unrestricted injection of fuel through the orifices.

Displacement of the distributor valve 50 is accomplished by electronically activating the solenoid 54 to draw down the armature 56 and displace the distributor valve 5 against the bias of the compression spring 62. When the solenoid 54 is deactivated, the compression spring 62 automatically displaces the armature 56 and the distributor valve 50 to the position shown in FIG. 2. In this position, the discharge line 82 is blocked and the alternate needle actuation line 88 is opened by positioning of the constriction 90 in the distributor valve 50 to open the actuation line 88, allowing high pressure fuel from the accumulator 18 to be directed against the enlarged back end 92 of the valve needle 32. This pressurized fuel hydraulically forces the needle 32, in a manner of a hydraulic piston, such that the end 42 of the needle 32 seats firmly against the inner wall 44 of the nozzle 28. In this position, as shown in FIG. 2, the distributor valve 50 has positioned itself such that discharge line 82 is blocked and a small pressure relief line 94 is opened to the low pressure reservoir 14. A substantial pressure differential enables an overwhelming force to be applied against the nozzle orifices such that peak pressures during combustion have no effect on the positioning of the valve needle. Fluctuations in the high pressure fuel supply are totally directed at the enlarged back end of the valve needle 32 directed toward closure and not opening through relief line nipple 96. The diameter of the back of the valve needle is many times larger than the needle tip, particularly where exposed to the discharge orifices 46.

Upon actuation of the fuel injector, the valve needle 32 is retracted as shown in FIG. 1, and an actuation return line 98 is opened by positioning the distributor valve 50 such that a reduced diameter neck 100 of the end extension 60, opens the return line 98. Fuel from the hydraulic activating chamber 104 behind the valve needle 32 escapes through return line 98 and nipple 102 to the low pressure reservoir 14. With the escape of fuel behind the valve needle 32, the full force of the hydraulic pressure in the supply fuel can act upon the front of the valve needle 32 to force it into its retracted position as shown in FIG. 1.

Figure 4:
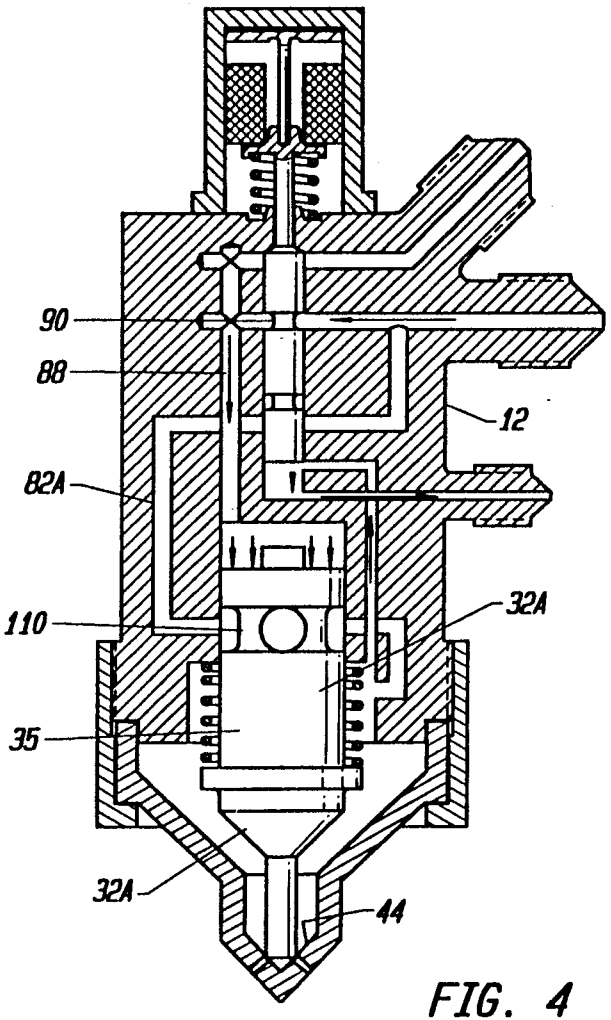
FIG. 4 is a cross sectional view of the injector of FIG. 3 with the valve needle in a closed position blocking fuel injection.
Figure 3:
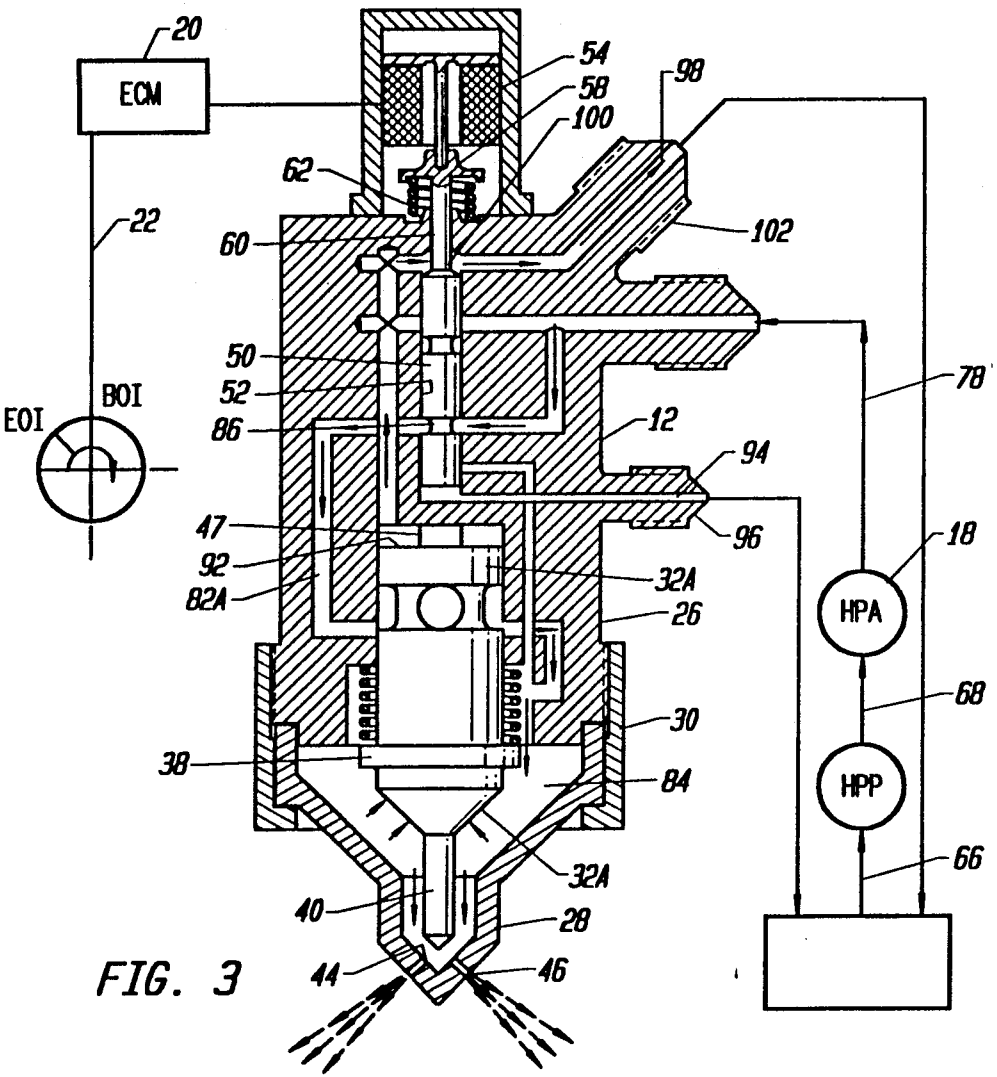
FIG. 3 is an alternate embodiment of the high pressure fuel injector system with the valve needle of the fuel injector in an open position during fuel injection.

Referring now to the alternate embodiment of FIGS. 3 and 4, a minor modification in the construction of the valve needle 32*a* produces a deliberate flutter or oscillation to the needle 32 to repeatedly expose and block the discharge orifices 46. This action provides a series of high frequency micropulses during each timed injection cycle pulse for improved combustion. As shown in FIG. 3, the high pressure fuel injection system 10 includes the same essential components as in the previous embodiment with a fuel reservoir 14, a high pressure pump 16, a high pressure actuator 18, and a fuel injector 12. The injector 12 is actuated by an electric control module 20 that monitors the operating conditions of the engine 24 through an input line 22 for creating the primary cycle pulse for the injector. The valve needle 32*a* has a constricted section 110 in the enlarged piston body 41 that is positionable in line with an altered route discharge line 82*a*. On displacement of the armature 56 on actuation of the solenoid 54 to connect the high pressure fuel line 78 to the discharge line 82*a* through the distributor valve 50 the plenum 84 in the nozzle 28 the valve needle 32*a* is caused to lift. This action causes the needle 32*a* to retract sufficiently as shown in FIG. 3, to substantially block the discharge line 82*a* such that the fuel in the plenum partially discharges. The resulting pressure drop allows the valve needle to return to the closed position whereupon discharge line 82*a* is again opened permitting free-flow of fuel to the plenum and forcing retraction of the needle valve. This unstable state causes a high frequency oscillation that results in a multipulsation of microjets that generates an ultra high atomization of the fuel with a gradual heat release and reduced combustion temperature. As noted in our prior U.S. Pat. No. 5,042,441 this fuel discharge profile can also be obtained electronically by electronic manipulation of a fuel injector of the type shown in FIGS. 1 and 2.

Figure 5:
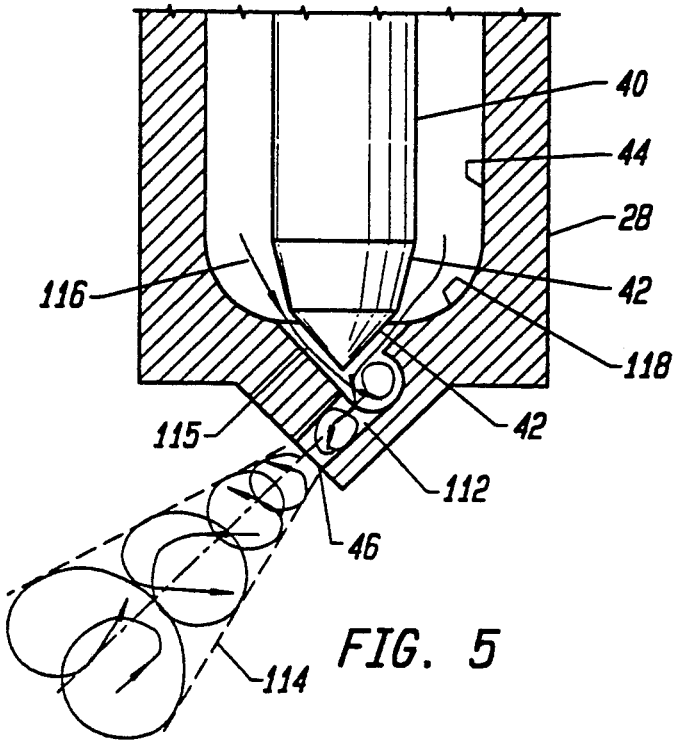
FIG. 5 is an enlarged cross-sectional view, partially fragmented of a fuel injector nozzle tip useable in the injectors of FIGS. 1 and 3.

With reference to FIG. 5, the preferred configuration of the nozzle 28 and orifice 46 upon actuation is shown. In this configuration, an orifice 46 having a tangentially arranged hole 112 causes the discharged fuel to swirl and generate a turbulent spray pattern 114 as shown schematically in FIG. 5. A supply passage 115 is formed between the needle tip 40 and the inner wall 44 of the nozzle 28. The end 42 of the nozzle has a taper 116 and the wall 44 has a dished portion 118 to provide substantially unconstricted flow to the conically constricted zone 120 between the tip end 42 and the conical segment of the nozzle wall 44. This restricted zone 120 regulates the acceleration of fuel flow such that the tangential orifice holes 112 can be oversized to iniate dispersion.

Figure 6:
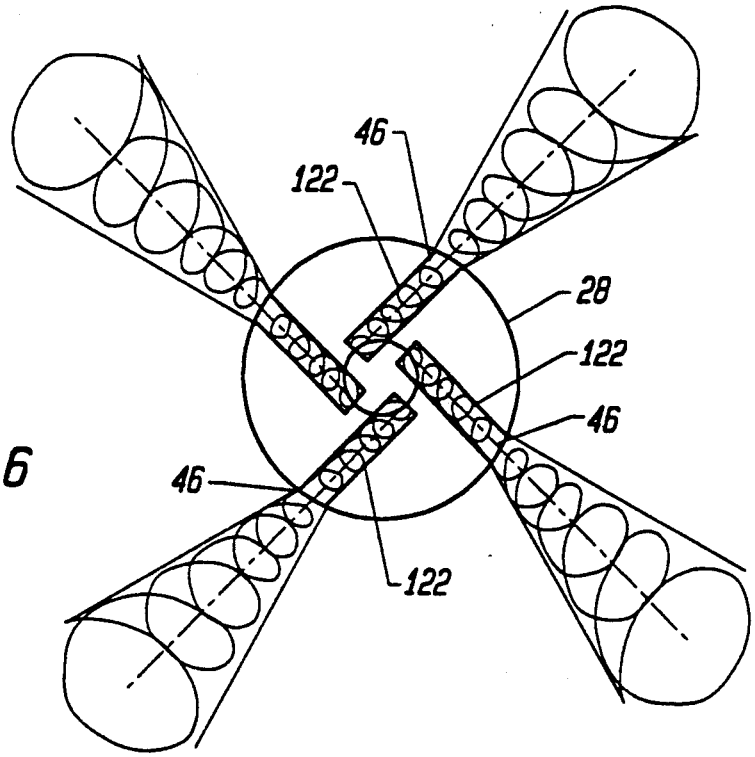
FIG. 6 is an enlarged end view, of an alternate fuel injector nozzle tip.

In a similar manner, the nozzle 28 of FIG. 6 includes multiple orifices 46 with multiple holes 122 that are tangentially oriented to the conical interior wall of the nozzle 28. This arrangement is particularly suitable for an injector positioned axially along the center line of an engine cylinder.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A high pressure fuel injector for internal combustion engines comprising:

a fuel injector body having a high pressure fuel admission passage and a low pressure fuel return passage;

a discharge nozzle connected to the injector body having a plenum and at least one fuel discharge orifice in communication with the plenum;

a displaceable valve needle having a needle tip and a piston body with a front end from which the needle tip projects and a back end, wherein the injector body has a vale needle bore and the piston body of the valve needle is slidable in the valve needle bore, with the back end of the needle valve and the valve needle bore forming a hydraulic chamber, and, wherein the discharge nozzle has a seat contactable by the needle tip in a position blocking the discharge orifice from communication with he plenum wherein said piston body of said valve needle includes valving means for periodically blocking the high pressure fuel passage to the plenum wherein oscillations in said valve needle occur in said first position of said distributor valve;

a displaceable distributor valve wherein the injector body has a distributor valve bore and the distributor valve is slidable in the distributor valve bore; and, means for reversibly displacing the distributor valve to a first position, wherein the high pressure fuel admission passage communicates with the plenum and discharge orifice on hydraulic displacement of the needle valve, and, a second position wherein the high pressure fuel admission passage communicates with the hydraulic chamber and urges the needle valve tip against the nozzle seat blocking the discharge orifice wherein the first position of the distributor valve, the low pressure fuel passage simultaneously communicates with the hydraulic chamber, and, in the second position of the distributor valve, the low pressure fuel passage communicates with the plenum.

2. The high pressure fuel injector of claim 1 wherein in the first position of the distributor valve, the low pressure fuel passage communicates with the hydraulic chamber, and, in the second position of the distributor valve, the low pressure fuel passage communicates with the plenum.

* * * * *